United States Patent [19]

Lovik

[11] Patent Number: 4,809,484

[45] Date of Patent: Mar. 7, 1989

[54] BALLOON STUFFING SYSTEM

[76] Inventor: Craig J. Lovik, 8565 Custer School Rd., Custer, Wash. 98240

[21] Appl. No.: 156,165

[22] Filed: Feb. 12, 1988

[51] Int. Cl.[4] ..... B65B 43/36; B65B 39/02; B65B 39/06; B65B 31/00

[52] U.S. Cl. ..... 53/434; 53/459; 53/570; 53/258; 53/385; 53/390; 53/262; 137/223; 137/268; 446/220

[58] Field of Search ..... 53/457, 459, 570, 385, 53/390, 258, 260, 262, 433, 434, 473; 137/268, 223, 1, 584; 446/220, 222, 223, 226

[56] References Cited

U.S. PATENT DOCUMENTS

| | | | |
|---|---|---|---|
| 1,203,967 | 11/1916 | Bowers | 137/223 X |
| 1,218,314 | 3/1917 | Read | 53/262 X |
| 1,229,794 | 6/1917 | Salzer . | |
| 1,321,833 | 11/1919 | Lyon | 137/223 |
| 1,374,975 | 4/1921 | Zeidler | 53/390 X |
| 1,471,886 | 10/1923 | Dessau . | |
| 2,592,347 | 4/1952 | Shute | 446/220 |
| 2,625,770 | 1/1953 | Steen et al. . | |
| 2,635,387 | 4/1953 | Anderson . | |
| 2,900,779 | 8/1959 | Baxter et al. | 53/390 X |
| 2,927,383 | 3/1960 | Longino . | |
| 2,962,803 | 12/1960 | Jones | 53/258 X |
| 3,298,156 | 1/1967 | Lerner | 53/385 X |
| 3,616,569 | 11/1971 | Litt et al. | 446/220 |
| 3,807,130 | 4/1974 | Pedersen | 53/258 |
| 3,827,210 | 8/1974 | Smalley et al. | 53/258 X |
| 3,935,691 | 2/1976 | Broch | 53/385 X |
| 4,028,775 | 6/1977 | Tysver | 53/258 X |
| 4,157,003 | 6/1979 | Kamphaus | 53/385 X |
| 4,203,269 | 5/1980 | Petersen | 53/258 X |
| 4,232,477 | 11/1980 | Lin . | |
| 4,335,538 | 6/1982 | Greenberg | 446/227 X |
| 4,597,244 | 7/1986 | Pharo | 53/434 |
| 4,639,232 | 1/1987 | Wang . | |
| 4,651,506 | 3/1987 | Lerner et al. | 53/385 X |
| 4,701,148 | 10/1987 | Cotey | 137/223 X |
| 4,704,934 | 11/1987 | Nosrati | 446/220 X |
| 4,737,133 | 4/1988 | Neumeier | 446/222 X |

*Primary Examiner*—Horace M. Culver

*Attorney, Agent, or Firm*—Hughes, Cassidy & Multer

[57] ABSTRACT

A balloon stuffing system (25, 25', 25'', 25''') including a tubular member (26) open at one end (28) thereof and defining a chamber (31) capable of receiving the object (49) to be stuffed into a balloon (50); an ejector rod (29) passing through the opposite end (30) of the tubular member (26); a flexible, bellows-like, fluid impervious element (34) surrounding the ejector rod (29) and sealed at one end to the end (30) of the tubular member (26) and at its opposite end to the ejector rod (29); a fluid inlet aperture (56, 81, 85) formed in the tubular member (26) for permitting coupling of the interior of the tubular member (26) to any suitable source of pressurizing fluid; and, a balloon (50) having its inlet aperture (55) and constricted neck portion (58) mounted in surrounding sealed relation to the open end (28) of the tubular member (26) so that upon pressurization of the interior of the tubular member (26), the balloon (50) is inflated, and upon axial movement of the ejector rod (29) towards the open end (28) of the tubular member (26) the object (49) located within the tubular member (26) is ejected from the tubular member (26) and projected into the inflated balloon (50) which can then be removed from the tubular member (26) and its constricted neck portion (58) knotted or otherwise tied off to seal the balloon (50) in its inflated state with the object (49) being retained captive therein. The balloon stuffing system (25, 25', 25'', 25''') may include a balloon stretching mechanism (68) for facilitating placement of balloons (50) on the end (28) of the tubular member (26).

35 Claims, 10 Drawing Sheets

BALLOON STUFFING SYSTEM

BACKGROUND OF THE INVENTION

1. Technical Field

The present invention relates generally to balloons; and, more particularly, to methods and apparatus for stuffing objects such, merely by way of example, as teddy bears and similar soft stuffed animals and/or toys, real and/or artificial flowers, and similar objects or favors into the interior of conventional balloons.

More specifically, the present invention relates to methods and apparatus comprising a balloon stuffing system which includes: (i) a relatively large diameter—e.g., from about one inch (1") to about four inches (4"), five inches (5"), or more—tubular member which is open at one end to permit reception and temporary storage of a soft stuffed toy or other object or favor, but which is otherwise sealed; (ii) a coupling for connecting the sealed tubular member to a source of air, helium or other inflation medium; (iii) provision for mounting the inflation aperture, or mouth, and constricted neck, of a conventional balloon uniformly over, about and around the open end of the sealed tubular member so as to create a single, enclosed, common, sealed chamber defined by the interior of the tubular member and the interior of the uninflated balloon; and (iv), a piston-like ejector rod axially movable through the tubular member and capable of being manually shifted for ejecting the stuffed toy or other favor from the tubular member and projecting it into the balloon; and, wherein the user need merely insert the stuffed toy or other object into the tubular member, attach the uninflated balloon to the open end of the tubular member, energize the source of inflation medium so as to pressurize the tubular member and balloon interiors and thereby inflate the balloon, shift the ejector rod axially through the tubular member to push the stuffed toy or other object out of the open end of the tubular member and into the now inflated balloon, and to thereafter twist the narrow constricted neck of the balloon adjacent the inflation aperture into a tight spiral and/or otherwise tie off the inflation aperture of the now inflated stuffed balloon as it is removed from the tubular member, whereupon the stuffed animal or favor is permanently retained within the inflated sealed balloon until such time as the balloon bursts.

2. Background Art

There are many occasions when people desire to utilize balloons in some form in connection with celebrations such, for example, as birthdays for both children and adults, anniversaries, various types of parties, grand openings, and a wide range of similar celebrations. Moreover, it is often desirable to utilize other tokens of affection in connection with such celebrations—e.g., flowers and/or small gifts for adult birthdays, anniversaries and the like; or stuffed animals and/or toys, favors and similar items for childrens' birthday parties.

Indeed, on some occasions in the past it has been known to stuff such favors or similar items into a balloon prior to inflation thereof so that the toy, flower or other favor is delivered to the recipient in an enclosed sealed balloon and can later be removed from the balloon—for example, by or upon bursting of the balloon—and used for its intended purpose. However, while the stuffing of flowers and other favors into uninflated balloons is known, and has been achieved, the technique employed is plagued with a number of difficulties; and, as a result, it has been a technique only rarely employed. Thus, when stuffing conventional balloons, the technique requires manual insertion of the favor through the relatively narrow, constricted, inflation aperture and constricted neck of the balloon prior to inflation thereof. An exemplary patent illustrating this technique is U.S. Pat. No. 1,471,886—Dessau, a patent which issued almost sixty-five (65) years ago. Thus, Dessau suggests the favor or other device be formed of crepe rubber ". . . which can be easily fashioned into varying shapes and can be temporarily rolled up into a compact form . . . ." so that it can ". . . be passed through the inflation aperture . . . ." of the balloon (Dessau Specification, Lines 27-31).

Other prior art patents of interest include U.S. Pat. Nos. 2,635,387—Anderson [a toy balloon novelty item employing a special valve configuration enabling inflation of a second balloon inside a first balloon]; 2,625,770—Steen, et al [a self-sealing toy balloon again providing for inflation of a second balloon within a first balloon]; and, 2,927,383—Longino [a balloon world satellite employing a pair of spaced, inflated, concentric, spherical body members and a satellite captive within the space therebetween].

Other patents of interest contemplate the employment of specially designed inflatable devices which are not conventional balloons and which are exemplified by U.S. Pat. Nos. 4,232,477—Lin [an inflatable hassock-shaped toy]; 4,335,538—Greenberg [an inflatable overhead crib gym toy]; and, 4,639,232—Wang [a toy having an envelope enclosing a movable mechanism]. Generally stated, the foregoing patents disclose relatively complicated devices formed of a plurality of pieces of material which are heat sealed together after toys and the like are inserted therein to form an enclosed, sealed, inflatable device.

Yet another patent of incidental interest is U.S. Pat. No. 1,229,794—Salzer which discloses an illuminated toy balloon and lighting effect which is achieved by inserting a flashlightshaped object through the inflation aperture and partially into an uninflated balloon.

However, none of the foregoing patents, nor any other prior art of which the present inventor is aware, permits the insertion of objects such as flowers, stuffed animals and similar favors into a completely conventional balloon following inflation thereof; none permit the insertion of such objects into a conventional balloon where the object has external dimensions many times greater than the dimensions of the balloon inflation aperture; and, none permit the insertion of objects, such as stuffed teddy bears or the like, which can occupy up to THIRTY PERCENT (30%), or more, of the total volume of space within the inflated balloon. Moreover the prior art of which the inventor is aware is totally devoid of any suggestion as to either special apparatus and/or methods for simplifying and readily facilitating the easy insertion of objects, including large overstuffed objects, into conventional inflated balloons.

SUMMARY OF THE INVENTION

The present invention overcomes all of the foregoing disadvantages by providing a simple, compact, rugged, inexpensive balloon stuffing system which requires only a single moving part; yet, which can be readily employed to insert a wide variety of objects—ranging from small buds or flowers, to small gifts, to overstuffed teddy bears and/or similar favors—into completely conventional balloons following inflation thereof, all on a rapid basis employing unskilled personnel who require essentially no training to operate the system. To this end, the balloon stuffing system of the present invention includes a relatively large diameter tubular member which is open at one end and sealed at the other, a manually operable, axially movable, piston-like ejector rod passing through the sealed end of the tubular member, and provision for connecting the interior of the tubular member to a source of air, helium or other suitable inflation medium. Thus, it is merely necessary to: (i) insert the stuffed animal or other favor to be stuffed into the balloon into the inside of the tubular member through the open end thereof; and (ii), stretch the inflation aperture, or mouth, and constricted neck, of an uninflated conventional balloon over, about and around the open end of the tubular member, thus totally sealing the interior thereof. Consequently, upon actuation of the source of inflation medium to pressurize the interior of the tubular member, the balloon is also pressurized, causing the balloon to be inflated to the desired degree. It is then merely necessary to manually shift the axially extending piston-like ejector rod in an axial direction towards the balloon, whereupon the favor disposed within the tubular member is ejected therefrom and projected into the interior of the inflated balloon.

The user can then, under most operating conditions, simply twist the balloon several times to form a tight spirally wound neck adjacent the inflation aperture, remove the balloon from the tubular member, and tie off the inflation aperture so as to enclose and seal the favor within the now inflated balloon. However, in some instances, particularly when utilizing large diameter tubular members—e.g., three inch (3″) to five inch (5″) diameter tubes or larger—and large balloons formed of relatively thick wall flexible latex material or the like, it may be difficult to twist the balloon sufficiently to effect a temporary seal prior to removal of the balloon from the tubular member; but, in such instances it is possible to shape the internal ejector rod assembly such that the inflation aperture and constricted neck of the balloon can be slipped axially off the tubular member into surrounding sealed relation with the small diameter end of the ejector rod assembly, thereby facilitating tying off and sealing of such balloons.

In one aspect of the invention, provision is made for enabling usage of the balloon stuffing system of the invention with a wide variety of different sized balloons. Thus, the system readily permits of the use of a small diameter tubular adapter which can be coupled to the large diameter tubular member in sealed relation therewith, thus permitting inflation and stuffing of small balloons using the adapter on the open end of the tubular member, while also permitting inflation and stuffing of large balloons without using the adapter.

Yet another important feature of the invention is the provision of an external stretching mechanism having a normally small diameter expandable end portion that can be readily inserted into the inflation aperture of conventional balloons—particularly those formed of heavy gauge or thick wall latex material and the like—and which, when retracted axially over the barrel defined by the tubular member, serves to expand the inflation aperture and constricted neck of the balloon as they are moved towards, over and about the periphery of the open end of the tubular member, thereby greatly facilitating the mounting of such balloons on the open ends of large diameter tubular members.

The present invention readily permits a large overstuffed soft animal or similar favor to be manually compressed and/or compacted and inserted into the tubular member; and, when the favor is later projected into the inflated balloon, it automatically reverts to its normal unstressed, uncompacted state. Merely by way of a non-limiting example, a balloon stuffing system made in accordance with the present invention and having a tubular member with a three inch (3″) inside diameter has been utilized to stuff a teddy bear approximately nine inches (9″) in breadth, six and three quarter inches (6 μ″) deep, and ten and one half inches (10 ½″) tall into a conventional balloon having an unstretched inflation aperture of only three quarter inch (¾″) diameter and where the balloon, when fully inflated, is approximately twelve inches (12″) in diameter.

In carrying out the invention, the tubular member of the balloon stuffing system may be hand held and manually operated or, alternatively, it can incorporate a laterally projecting mounting bracket or clamp enabling it to be secured in a generally vertical position to a table or work bench.

DESCRIPTION OF THE DRAWINGS

These and other objectives and advantages of the present invention will become more readily apparent upon reading the following Detailed Description and upon reference to the attached drawings, in which:

FIG. 9 is a fragmentary vertical view, partly in section and somewhat similar to FIG. 6, but here illustrating a slightly modified ejector rod assembly construction which is particularly suitable for use with large diameter tubular members when being employed to inflate and stuff relatively large balloons formed of heavy gauge or thick wall latex material or the like;

FIG. 18 is a fragmentary isometric view of a slightly modified form of balloon stuffing system which is here suitable for use with conventional tire inflation pumps and the like;

Figure 1:
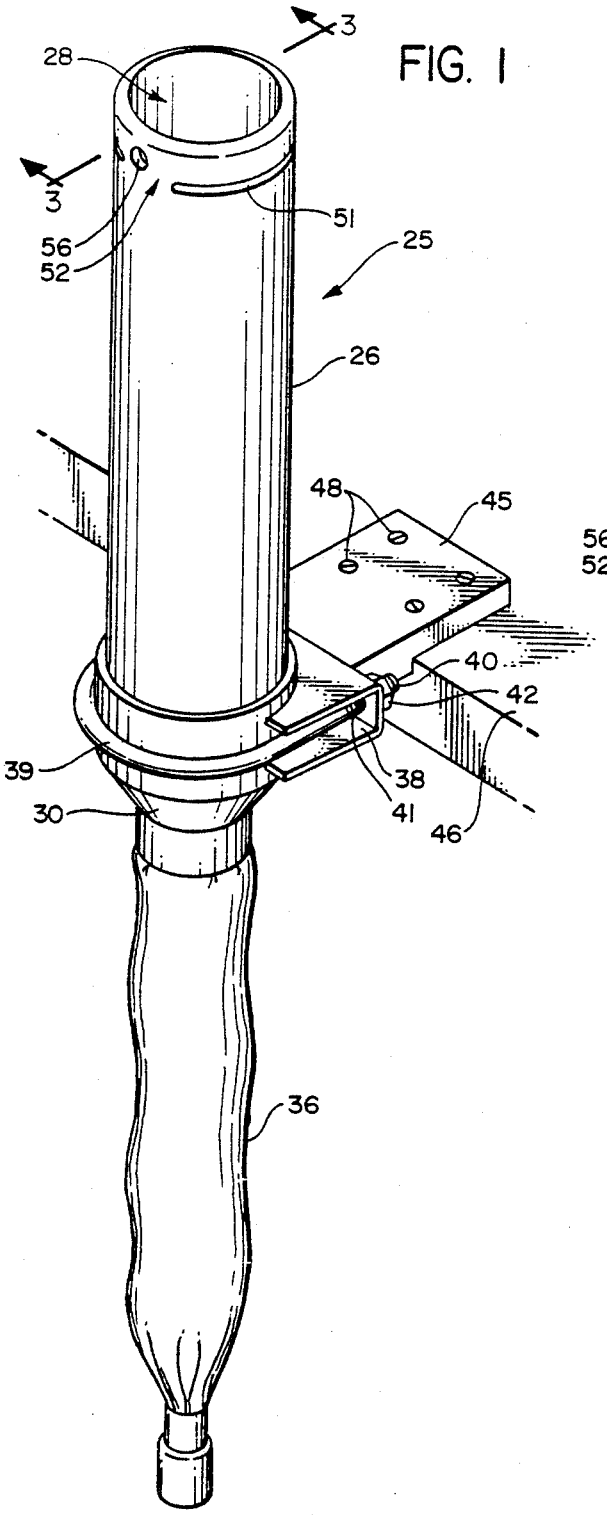
FIG. 1 is an isometric view of a balloon stuffing system made in accordance with the present invention, here illustrating the system with a laterally projecting mounting bracket physically secured to a table or work bench.

While the invention is succeptible of various modifications and alternative forms, specific embodiments thereof have been shown by way of example in the drawings and will herein be described in detail. It should be understood, however, that it is not intended to limit the invention to the particular forms disclosed but, on the contrary, the intention is to cover all modifications, equivalents and/or alternatives falling within the spirit and scope of the invention as expressed in the appended claims.

DETAILED DESCRIPTION

Turning now to the drawings, and as best illustrated by reference to FIGS. 1 and 3 conjointly, an exemplary balloon stuffer, generally indicated at 25, embodying features of the present invention has been depicted. As here shown, the exemplary balloon stuffer 25 incorporates an elongate hollow tubular member 26 which is open at its upper end, as generally indicated at 28. An elongate ejector rod 29, best illustrated in FIG. 3, extends through the opposite end 30 of the tubular member 26 and partially into the chamber 31 defined by the interior thereof. The illustrative ejector rod 29 is here provided with an ejector support platform 32 at its upper end and is housed within a totally enclosed, fluid impervious, flexible membrane 34 having its upper end 35 affixed to the lower end 30 of tubular member 26 in fluid tight sealed relation thereto. Although not essential to the invention, the flexible membrane 34 may be enclosed within a soft, flexible pouch or bag 36 formed of fabric or the like so as to minimize the danger of damage thereto. And, of course, although not illustrated in the drawings, those skilled in the art will appreciate as the ensuing description proceeds, that the flexible membrane 34 could take the form of a sealed bellows-type flexible tube of entirely conventional construction.

In order to facilitate use of the balloon stuffer 25 of the present invention, provision may be made for mounting the balloon stuffer 25 in a generally vertically oriented fixed position on a suitable work surface. To accomplish this, the exemplary balloon stuffer 25 of the present invention includes a generally C-shaped mounting bracket 38 adapted to be removably, but fixedly, secured to the lower end of the tubular member 26 by a U-shaped fastening element 39 having threaded extremities 40 adapted to be passed through openings 41 formed in bracket 38 and secured to place by means of nuts 42 or the like. Bracket 38 may be secured by screws 44 or the like to a latterally projecting mounting block 45 which, in turn, can be removably affixed to a table or other work surface 46 by means of screws 48 or suitable clamps (not shown) or the like.

Figure 2:
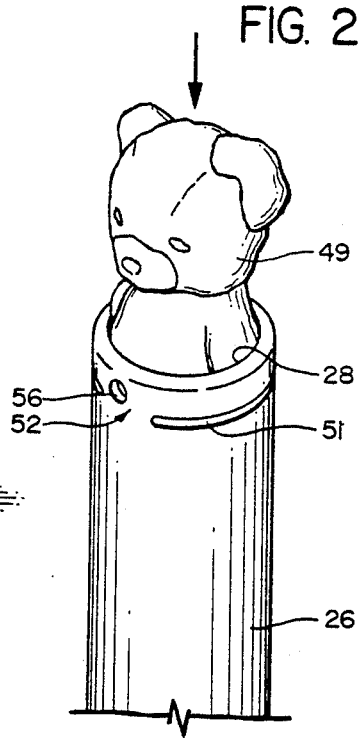
FIG. 2 is a fragmentary isometric view of the upper end of the balloon stuffing system shown in FIG. 1, here depicting a soft, overstuffed teddy bear as it is being inserted into the open end of the balloon stuffer's tubular body.
Figure 3:
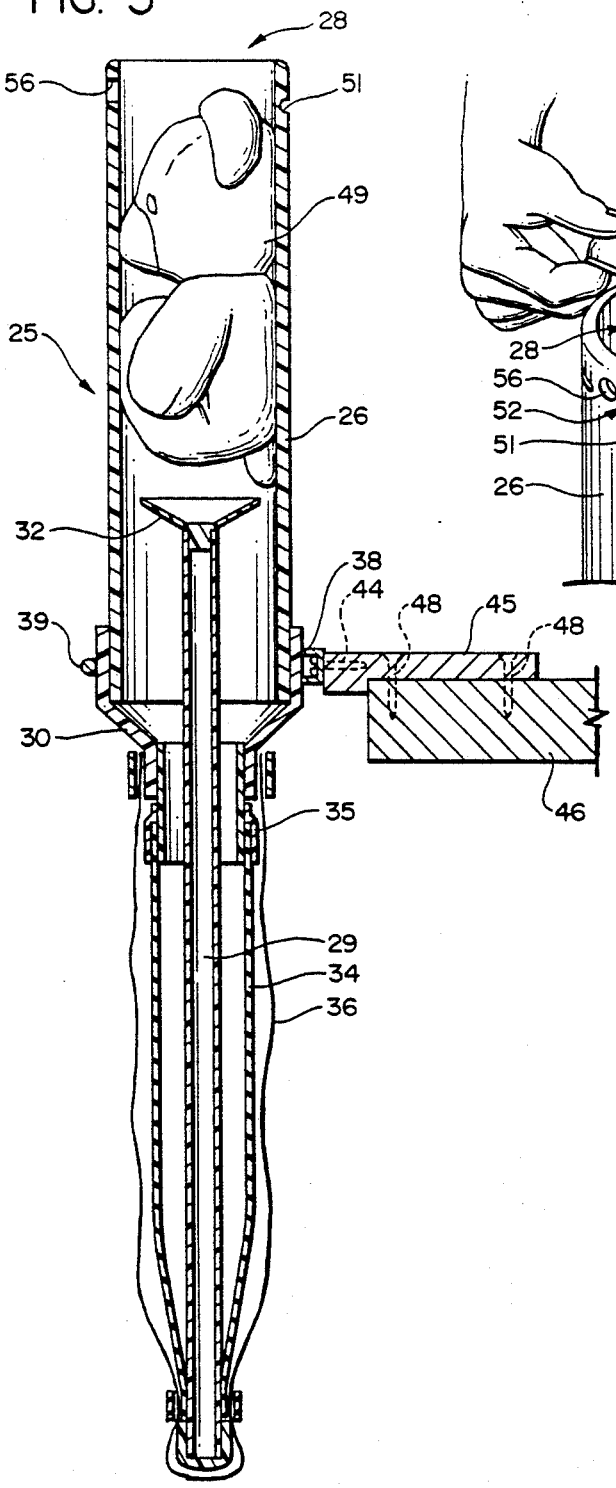
FIG. 3 is a vertical sectional view taken substantially along the line 3—3 in FIG. 1, and here depicting the teddy bear of FIG. 2 fully inserted into the interior of the balloon stuffer's tubular member.

In use of the balloon stuffer 25 of the present invention, the operator need merely take the toy, flower or other favor—for example, a relatively soft stuffed teddy bear as indicated at 49 in FIG. 2—and insert it axially through the open end 28 of the tubular member 26 and push it downwardly (as indicated by the arrow in FIG. 2) into the barrel of tubular member 26 until it is entirely contained within the chamber 31 defined thereby, as best illustrated in FIG. 3. It will be apparent upon inspection of FIG. 3 that the stuffed teddy bear 49, when in the unstressed or uncompacted condition, would be considerably larger than the inside diameter of the tubular member 26; but, the soft overstuffed nature of this type of toy readily permits the operator to compress or compact the toy as it is physically pushed or stuffed into chamber 31. However, when stuffing other more delicate or fragile favors—for example, artificial or real flowers (not shown in FIGS. 1–3)—it is not desirable to compress or stress such objects in any way; and, therefore, when dealing with such objects it is necessary to employ a balloon stuffer 25 having a tubular member 26 that is sufficiently large to accommodate delicate and/or fragile favors without compaction.

Figure 4:
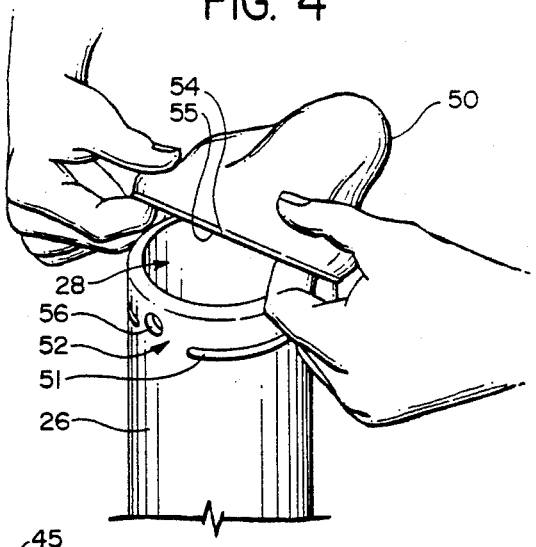
FIG. 4 is a fragmentary isometric view here illustrating the manual stretching of the inflation aperture of a conventional balloon as it is being manually placed over the open end of the balloon stuffer's tubular member.

In accordance with another of the important aspects of the present invention, provision is made for mounting an inflatable balloon, generally indicated at 50 in FIG. 4, over the open end 28 of the tubular member 26—after placement of the teddy bear 49 or other favor inside the tubular member as shown in FIGS. 2 and 3—in such a way that the interior of the balloon 50, together with chamber 31 in tubular member 26, define an enclosed, totally sealed space with the teddy bear 49 or other favor initially located within the chamber 31. To accomplish this, the upper, outer periphery of the tubular member 26 is preferably provided with a peripherally disposed groove 51 which is spaced from the open end 28 of tubular member 26 and which extends entirely about the perimeter of the tubular member except for a single, relatively short, arcuate segment indicated at 52 in FIG. 4. Thus, the arrangement is such that the groove 51 provides a seat for locating, receiving and retaining the rolled bead 54 located at the extremity of the inflation aperture 55 of balloon 50. In operation, the user merely needs to grasp opposite edges of the inflation aperture 55 on balloon 50 and stretch and aperture over, about and around the open end 28 of tubular member 26 in the manner shown in FIG. 4, until the rolled bead 54 at the extremity of the inflation aperture 55 is seated in the groove 51 in the manner shown in FIG. 5. The balloon stuffer 25 is now in condition for inflation of the balloon and ejection of the teddy bear or other favor therein.

In order to enable pressurization of chamber 31 and the interior of balloon 50, provision is made for coupling the chamber 31 in tubular member 26, and therefore the interior of balloon 50, to a suitable source of air, helium or other inflation medium. To this end, and in accordance with the form of the invention depicted in FIGS. 1–17, 20 and 21, the tubular member 26 is provided with an inflation air inlet 56 which is preferably disposed centrally within the region 52 devoid of groove 51 and approximately midway between the plane containing groove 51 and the plane containing the open end 28 of tubular member 26. Thus, the arrangement is such that both prior to, and subsequent to, inflation of the balloon 50, the constricted neck portion 58 of the balloon overlies the inflation air inlet 56 and serves to totally seal the chamber 31, as best shown in FIG. 6.

Figure 5:
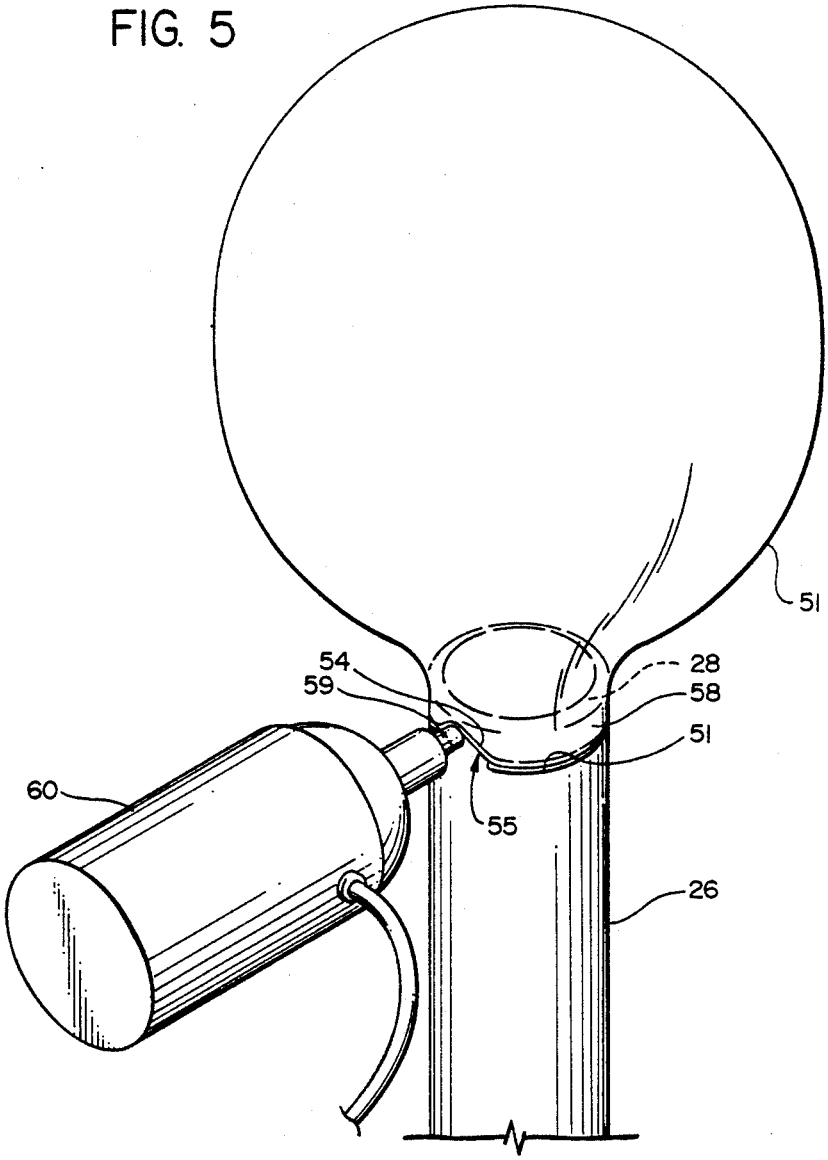
FIG. 5 is an isometric view here illustrating a conventional electrically powered air inflater being used to pressurize the interior of the balloon stuffer's tubular member and, therefore, the interior of the balloon secured to the end thereof so as to inflate the balloon.
Figure 6:
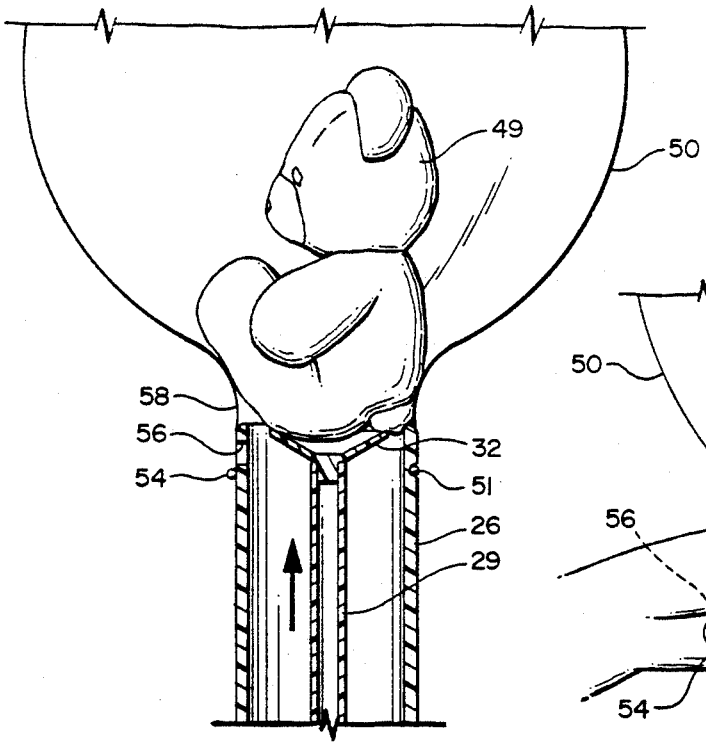
FIG. 6 is a fragmentary vertical view, partly in section, here illustrating the upward axial movement of the ejector rod to manually eject the stuffed teddy bear from the interior of the tubular member and to project it into the interior of the inflated balloon.

However, during inflation of the balloon 50, the operator need only push the constricted neck portion 58 of the balloon upwardly a distance sufficient to uncover the inflation air inlet 56—but, not to or beyond the open end 28 of tubular member 26—and, the absence of a groove 51 in the region 52 of tubular member 26 facilitates such upward movement of the constricted neck portion 58 of balloon 50, all as best indicated in FIG. 5. At this point in the balloon stuffing cycle of operation, the operator need merely insert the inflation nozzle 59 of any suitable and conventional inflation device 60 (FIG. 5) into the inflation air inlet 56, thus again plugging and totally sealing chamber 31 which is now directly coupled to a source of air, helium or other inflation medium. While any suitable and conventional inflation device 60 may be employed, excellent results have been obtained when using an electrically powered air inflater of the type marketed by Siesta Corp. of Northbrook, Ill. for inflating air mattresses, inflated furniture, boats, beach balls, floats and similar inflatables.

The arrangement is such that upon turning the air inflator 60 "ON", the interior chamber 31 of tubular member 26 and, therefore, the interior of balloon 50, are pressurized, thus inflating the balloon to the desired degree—for example, to the degree shown in FIG. 5—at which point: (i) the air inflater 60 is turned "OFF"; (ii) the injection nozzle 59 on the air inflator 60 is withdrawn from the inflation air inlet 56; and (iii), the constricted neck portion 58 of the balloon 50 is again moved downwardly to the position shown in FIG. 6 where the latex material of the balloon overlies and totally seals the inflatin air inlet 56, thus maintaining the balloon 50 in the inflated state.

The operator is now ready to stuff the teddy bear 49 or other favor (which is still disposed within the chamber 31 in tubular member 26) into the now inflated balloon 50. To accomplish this, and as best illustrated in FIG. 6, it is merely necessary to manually shift the ejector rod 29 upwardly in the direction of the arrow in FIG. 6 so as to engage the lower end of the teddy bear 49 or other favor with the ejector support platform 32 and project the teddy bear 49 or other favor upwardly and fully into the inflated balloon 50. At this point, and with most small or medium sized thin wall balloons, the operator need only turn the balloon 50 several times relative to the balloon stuffer 25 so as to tightly wind the constricted neck portion 58 of the balloon 50 into a tight spiral or helical configuration, generally indicated at 60 in FIG. 7, thereby effecting a temporary seal for the balloon.

Figure 8:
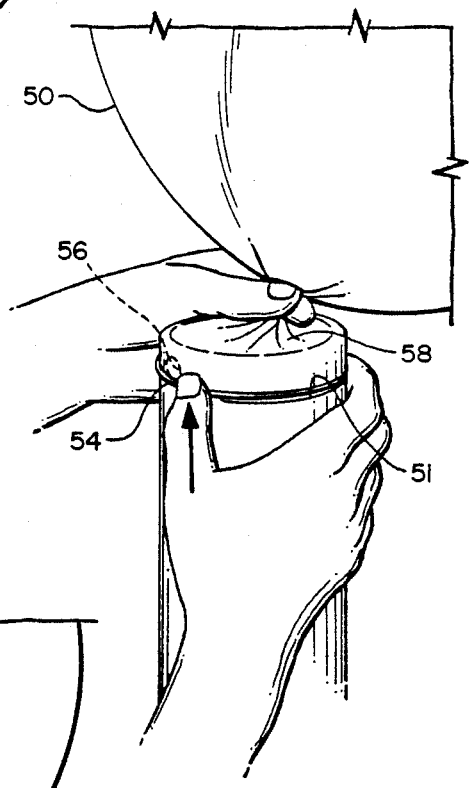
FIG. 8 is a fragmentary isometric view here illustrating how the user manually removes the now stuffed, inflated balloon from the balloon stuffer prior to tying the balloon off.

As best shown in FIG. 8, the operator can then simply grasp the spirally wound, constricted neck portion 58 of the inflated stuffed balloon—for example, between the thumb and forefinger of one hand—while using the other hand to shift the rolled bead 54 and inflation inlet 55 of the balloon 50 upwardly in the area of the ungrooved region 52 at the upper end of tubular member 26 so as to remove the inflated stuffed balloon 50 from the balloon stuffer 25. The constricted neck portion 58 of the balloon 50 can now be knotted in a conventional fashion (not shown) or otherwise tied off so as to permanently seal the inflated balloon with the teddy bear 49 or other favor stuffed inside.

Figure 7:
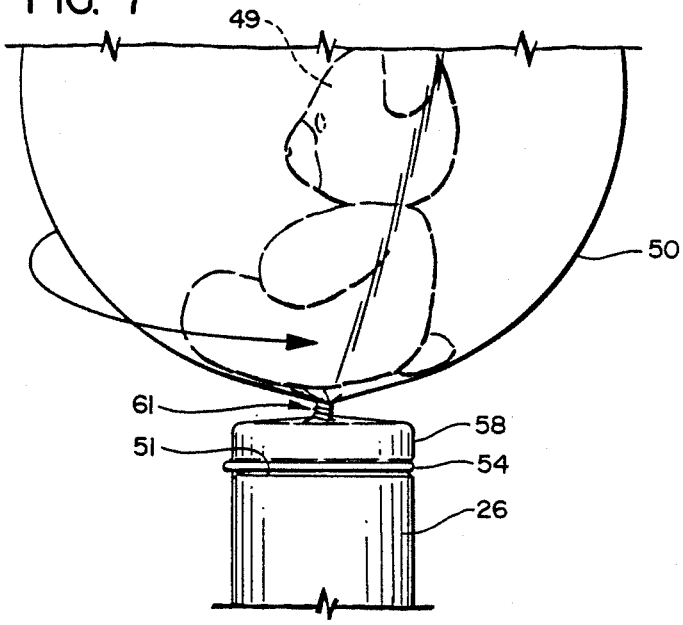
FIG. 7 is a fragmentary side elevational view here illustrating the manner of twisting the stuffed balloon prior to removal from the tubular member of the balloon stuffer so as to form a tightly wound spiral in the constricted neck portion of the balloon adjacent the inflation aperture so as to effect a temporary seal for the balloon.

While the foregoing procedure for removing and tying off an inflated stuffed balloon 50 as described in connection with FIGS. 7 and 8 has proven highly effective and may be readily carried out by even unskilled and untrained operators when using tubular members 26 having a diameter of approximately three inches (3″) or less to inflate and stuff small and medium sized balloons 50 formed of thin wall latex material or the like, it has been found to be more difficult to remove larger balloons 50, particularly those formed of thick wall latex material or the like, which are intended to be inflated and stuffed with a balloon stuffer 25 having a tubular member 26 with an inside diameter of greater than three inches (3")—for example, four inches (4"), five inches (5"), or more.

Figure 9:
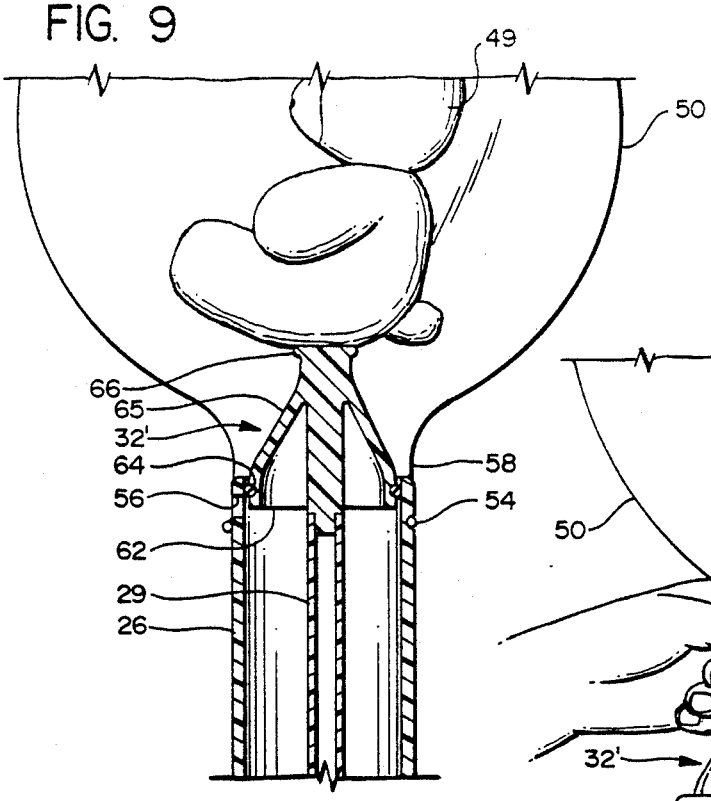

Therefore, to facilitate removal of such inflated stuffed balloons, a slightly modified ejector support platform, best indicated at 32' in FIG. 9, may be employed. Thus, as here shown, the modified ejector platform 32' consists of a disc-shaped base portion 62 having a diameter closely approximating, but slightly less than, the inside diameter of tubular member 26, with a conventional wiping seal 64 being mounted about the periphery of the disc-shaped base 62 and disposed in sealed wiping relation to the inner surface of the tubular member 26. The upper portion of the modified ejector support platform 32' is preferably formed with a converging shape—for example, a frusto-conical configuration as best shown at 65 in FIGS. 9–11, terminating at its apicad end in an outwardly flared lip 66 which preferably has a considerably smaller outside diameter of approximately one and one quarter inches (1 ¼") or, slightly larger than the normal unstretched diameter of the constricted neck portion 58 of a relatively large balloon 50.

Figure 11:
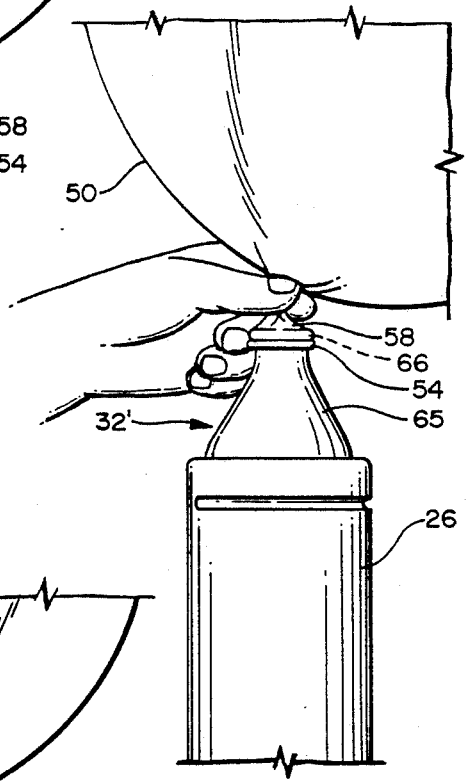
FIG. 11 is a fragmentary isometric view similar to FIG. 8, but here illustrating the manner of removing the balloon depicted in FIG. 10 from the balloon stuffer's ejector rod assembly without permitting deflation thereof.
Figure 10:
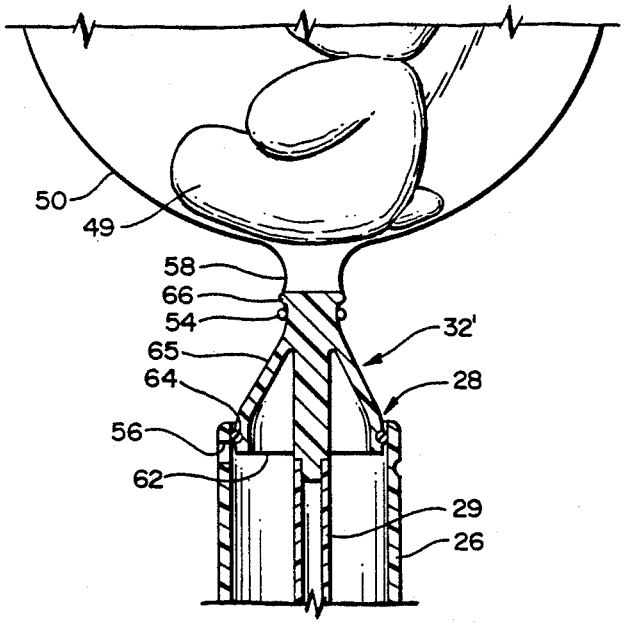
FIG. 10 is a fragmentary side elevational view, somewhat similar to FIG. 9, but here illustrating the balloon after stuffing thereof and after sliding the end of the balloon incorporating the inflation aperture off the tubular member and into sealed relation around the reduced end of the projecting ejector rod assembly.

Thus, the foregoing arrangement permits the operator to inflate and stuff the balloon 50 fragmentarily shown in FIG. 9 in precisely the same manner as previously described in connection with the embodiment of the inventioon shown in FIGS. 1–6. However, in this instance, as the modified ejector support platform 32' moves upwardly in the manner shown in FIG. 9, the wiping seal 64 moves above the inflation air inlet 56 formed in tubular member 26 and establishes a momentary seal between chamber 31 in tubular member 26 and the interior of the balloon 50. As a consequence, the operator can again manually shift the rolled bead 54 surrounding the inlet air aperture 55 on the balloon 50 upwardly in the manner previously described in connection with FIG. 8; and, when shifted above and off the open end 28 of the tubular member 26, the constricted neck portion 58 of the balloon contracts and forms an effective seal surrounding the apicad end of the frusto-conical portion 65 of the modified support platform 32' immediately beneath the reduced diameter lip 66, as best shown in FIG. 10. The inflated and stuffed balloon 50 can now be twisted, if desired, in the manner previously described in connection with the embodiment of the invention shown in FIG. 7, and/or removed from the modified ejector support platform 32' in the manner previously described, all as best shown in FIG. 11.

Those persons skilled in the art relating to balloons will, of course, appreciate that many balloons—particularly the larger balloons employing a thick wall latex structure or the like—tend to exert considerable resistance to stretching of the constricted neck portion 58 in the manner illustrated in FIG. 4; and, therefore, the operator may find it difficult, if not virtually impossible, to manually stretch the constricted neck portion 58 of the balloon 50 by an amount sufficient to permit proper placement of the balloon over the open end 28 of the tubular member 26 of a balloon stuffer 25; and, this difficulty is greatly exacerbated when the tubular member 26 has an outside diameter of approximately four inches (4") or more. Accordingly, in order to resolve this problem, the present invention may include a balloon stretching mechanism of the type generally indicated at 68 as best shown by reference to FIGS. 12 and 13 conjointly.

As here shown, the exemplary stretching mechanism 68 is deployed about a slightly modified balloon stuffer 25' which is virtually identical in structure and operation to the balloon stuffer 25 previously described in connection with the exemplary embodiments of the invention shown in FIGS. 1–11. However, in this instance, the modified balloon stuffer 25', rather than including a peripheral groove such as the groove 50 depicted in FIGS. 2–4 for purposes of properly positioning the balloon 50, includes an integral peripheral collar 69 adjacent its uppermost end and defining a generally right angle inturned flange 70 at its lowermost end which extends entirely about the periphery of the tubular member 26 except for a ramp-shaped region 71 in a relatively short arcuate portion of the collar 69. Again, however, the inflation air inlet 56 is positioned generally centrally of the collar 69 in the ramp-shaped region 71. As a consequence of this construction, when the constricted neck portion 58 of a balloon 50 is stretched over, around and about the open end 28 of the tubular member 26, the rolled bead 54, rather than being seated in the groove 51 shown in FIGS. 2–4, is seated under the inturned peripheral flange 70 and securely retained in place, again serving to seal the inflation air inlet 56 in precisely the manner previously described.

Figure 12:
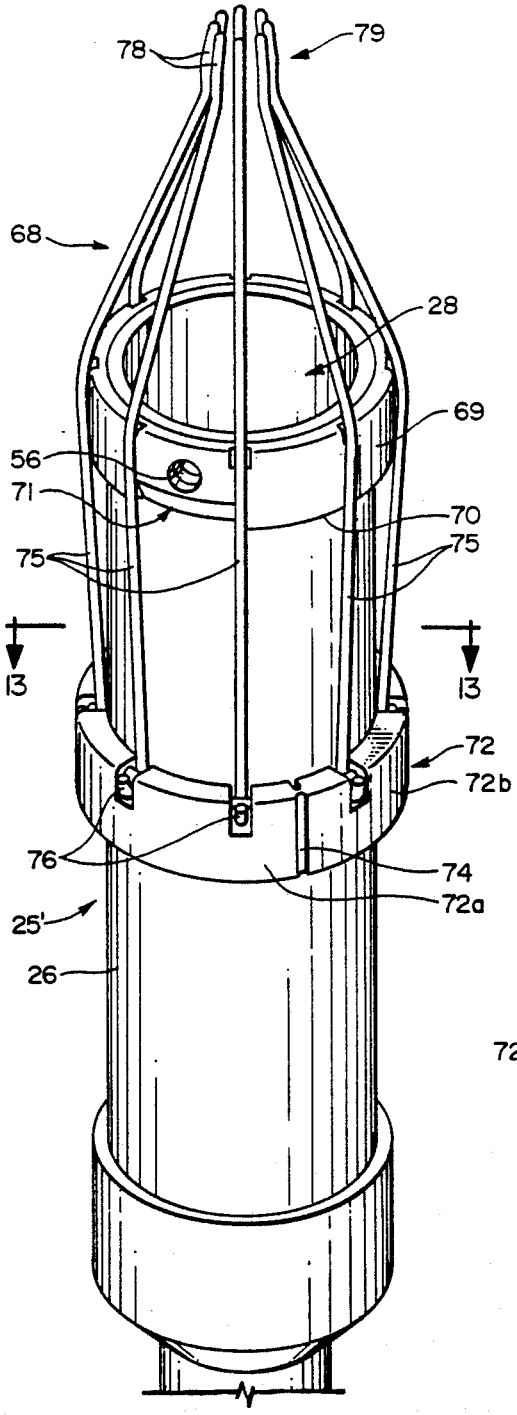
FIG. 12 is a fragmentary isometric view of a slightly modified balloon stuffer embodying features of the present invention and similar to that shown in FIG. 1, but here incorporating a stretching mechanism which is particularly suitable for automatically stretching the inlet aperture of relatively large thick wall balloons as they are being moved towards, over and about the free open end of the balloon stuffer's tubular member.
Figure 14:
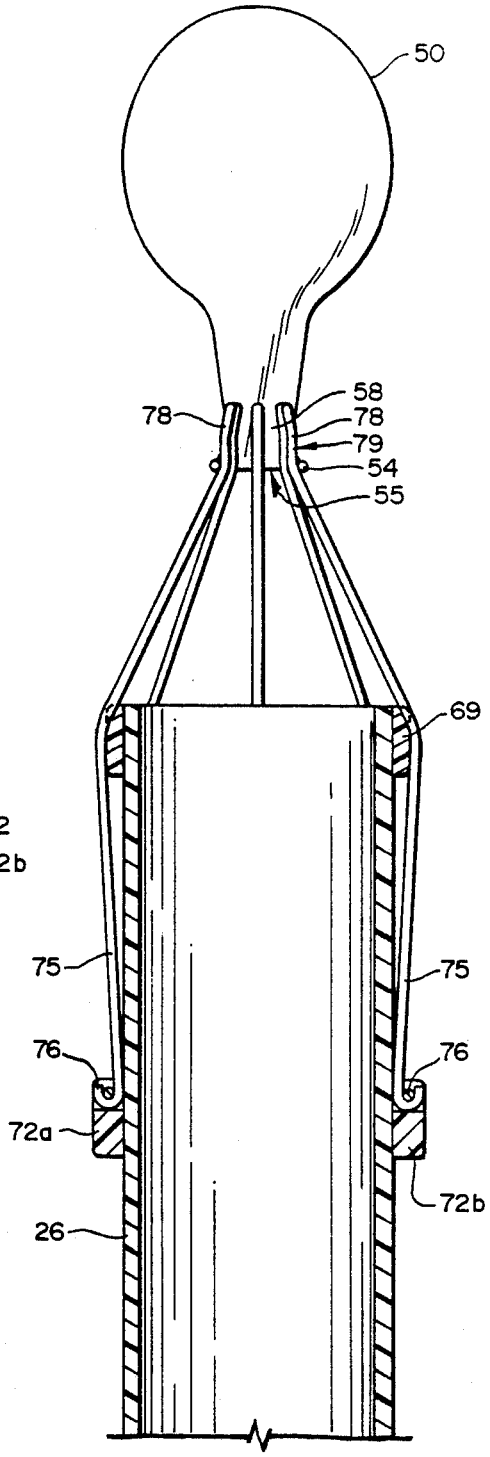
FIG. 14 is a fragmentary vertical sectional view here illustrating the initial step of using the balloon stretcher of FIG. 12 wherein the inflation aperture and constricted neck of a conventional uninflated balloon are positioned over the reduced diameter free end of the stretching mechanism.
Figure 13:
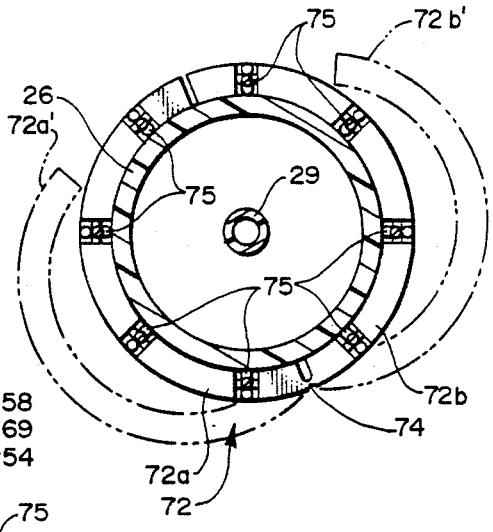
FIG. 13 is a sectional view of the balloon stuffer and stretching mechanism taken substantially along the line 13—13 in FIG. 12, here illustrating the stretching mechanism in solid lines in position to perform a balloon stretching operation, and in phantom lines in position to be mounted on and/or removed from the balloon stuffer.
Figure 15:
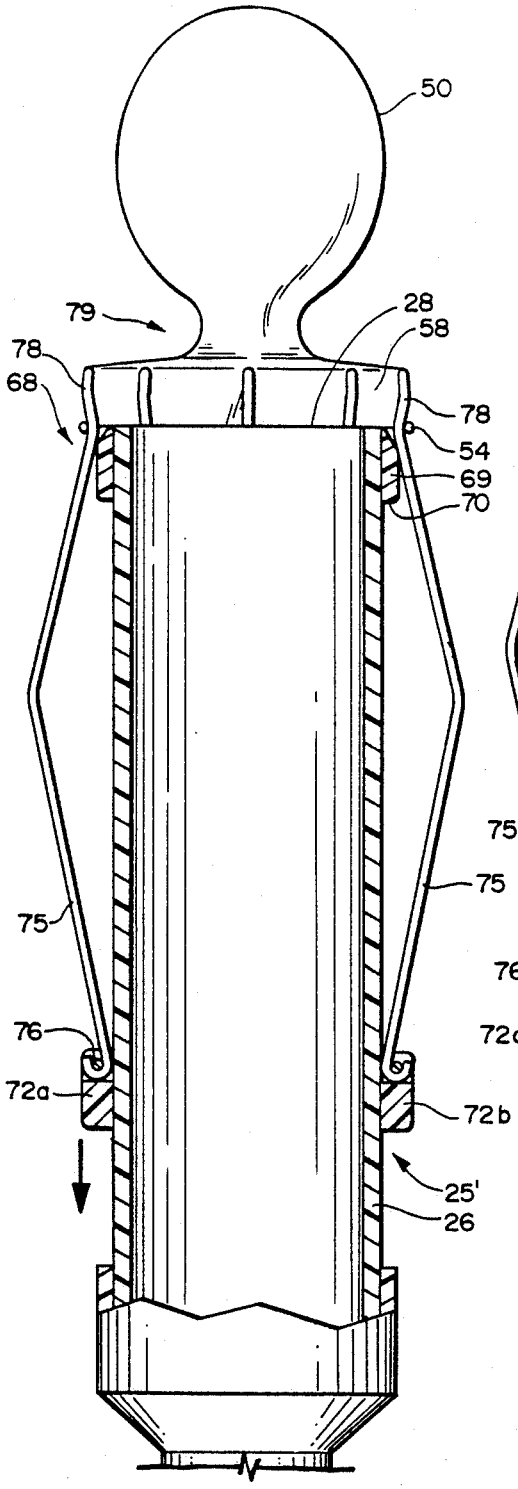
FIG. 15 is a fragmentary vertical sectional view similar to FIG. 14; but here illustrating the system with the balloon stretching mechanism having been symmetrically expanded about the free end of the balloon stuffer's tubular member so as to position the stretched inflation aperture and constricted neck of the uninflated balloon in position to be mounted about the balloon stuffer's tubular member in sealed relation therewith.

In carrying out the balloon stretching operation of the present invention, the balloon stretching mechanism 68 preferably includes a split collar generally indicated at 72 formed of two (2) mating C-shaped collar sections **72*a*, 72*b* which are, as best illustrated in FIG. 13, hingedly secured together at one junction of the mating C-shaped collar sections 72*a*, 72*b*, as generally indicated at 74. A plurality of peripherally spaced, axially extending, generally parallel stretcher elements 75 are hingedly connected to the collar sections 72*a*, 72*b*, as generally indicated at 76, there being eight (8) such stretcher elements 75 employed in the exemplary embodiment of the invention shown in FIGS. 12 and 13. Approximately midway along their lengths, the stretcher elements 75 are each angled inwardly so as to converge towards one another, terminating at their free ends in slightly reversely bent end portions 78 which, when closely spaced together as shown in FIG. 12, define a plurality of closely spaced stretcher elements having a somewhat keg-shaped configuration, generally indicated at 79**, approximately one inch (1") in length and slightly less than one inch (1") in diameter.

In order to apply the balloon stretching mechanism 68 to the modified balloon stuffer 25' —or, for that matter, to the balloon stuffer 25 of FIGS. 1–11—the operator need only spread the collar sections **72*a*, 72*b* from the solid line position shown in FIG. 13 to the phantom line positions shown at 72*a*', 72*b*' by opening the collar sections 72*a*, 72*b* about their hinged connection 74. The balloon stretching mechanism 68 is then mounted in surrounding relation to the tubular member 26 of balloon stuffer 25' and the collar sections 72*a*, 72*b* are closed to their solid line positions indicated in FIG. 13 with the collar 72 now being mounted about the tubular member 26 with freedom for axial sliding movement relative thereto. In order to remove the balloon stretching mechanism 68 following mounting of a balloon over, about and around the open end 28 of the tubular member 26**, the operator again manually opens the collar sections 72*a*, 72*b* to their phantom line positions 72*a'*, 72*b'* shown in FIG. 13, at which point the stretcher mechanism 68 can be separated from the balloon stuffer 25' (25).

The operation of the exemplary balloon stretching mechanism 68 will now be described with reference to FIGS. 14, 15, 16 and 17 considered consecutively. Thus, referring first to FIG. 14, it will be observed that the balloon stretching mechanism 68 has been applied to the balloon stuffer 25' with the collar 72 located about midway along the axial length of the tubular member 26 so as to permit the lowermost ends of the stretcher elements 75 to lie in a vertical, slightly diverging array extending towards the open end 28 of the tubular member 26; and, with the upper ends of the stretcher elements 75 converging inwardly above the open end 28 of the tubular member 26 and terminating in a somewhat keg-shaped configuration 79 having a diameter closely approximating the diameter of the unstretched inflation aperture and constricted neck portion 58 of a conventional balloon 50. As a consequence, the operator may easily mount the constricted neck portion 58 of a balloon 50 over the keg-shaped configuration 79 defined by the closely spaced, reversely bent end portions 78 of stretcher elements 75, as clearly shown in FIG. 14.

At this point, the balloon 50 itself serves to maintain the collar sections 72*a*, 72*b* of the balloon stretching mechanism 68 in their closed state. Therefore, the operator need merely retract the closed collar sections 72*a*, 72*b* —i.e., move them downwardly in the direction of the arrow shown in FIG. 15; and, as the balloon stretching mechanism 68 is moved downwardly, the converging uppermost ends of the stretcher elements 75 are cammed outwardly away from one another by virtue of engagement with the collar 69 surrounding the uppermost open end 28 of tubular member 26—i.e., the diameter of the keg-shaped configuration 79 defined by the reversely bent inturned end portions 78 of the stretcher elements 75 is greatly increased, thus automatically stretching the inflation aperture and constricted neck portion 58 of the balloon 50. Thus, by the time that the balloon stretching mechanism 68 has reached the position depicted in FIG. 15, the lowermost extremities of the balloon's inflation aperture and constricted neck portion 58 have been stretched to a diameter slightly greater than the diameter of collar 69; and, as the collar sections 72*a*, 72*b* are moved further downwardly to the position shown in FIG. 16, the expanded, or stretched, inflation aperture and constricted neck portion 58 of balloon 50 are drawn downwardly into surrounding relation to the collar 69.

Figure 16:
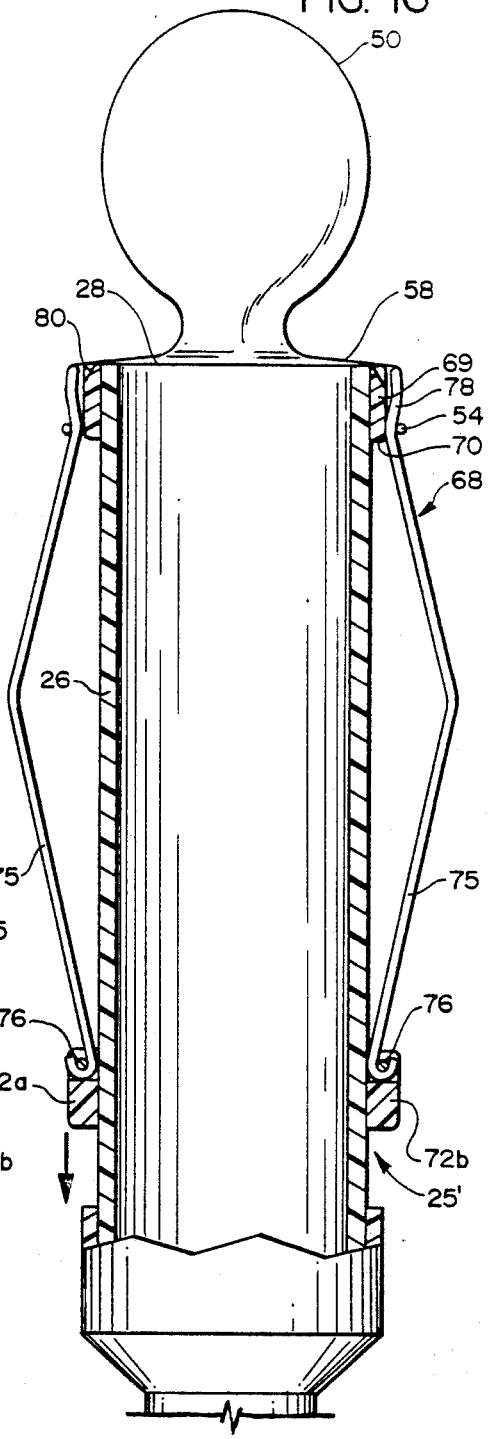
FIG. 16 is a fragmentary vertical sectional view similar to FIGS. 14 and 15, but here illustrating the position assumed by the infltion aperture and constricted neck of the uninflated balloon as the balloon stretching mechanism is retracted in an axial direction.

Finally, as the balloon stretching mechanism 68 is further retracted to the position shown in FIG. 16, the reversely bent end portions 78 of the stretcher elements 75 pass downwardly below the inturned flange 70 on collar 69, permitting them to release the inflation aperture and constricted neck portion 58 of the balloon 50 and allow its rolled bead 54 to be positively seated beneath flange 70. Such release action can, if desired, be further facilitated by the operator simply by expanding the hinged collar sections 72*a*, 72*b* slightly and physically removing the balloon stretching mechanism 68 from the balloon stuffer 25'.

Figure 17:
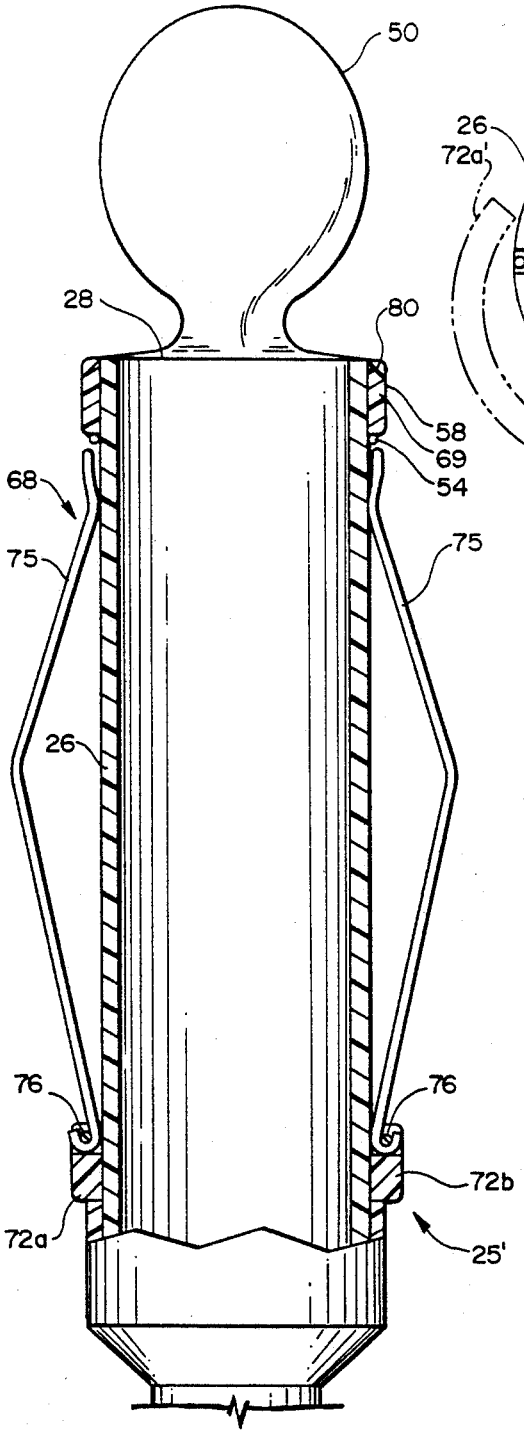
FIG. 17 is a fragmentary vertical sectional view similar to FIGS. 14–16, but here illustrating the relative positions of the balloon stuffer's tubular member, the balloon stretching mechanism, and the inflation aperture and constricted neck of an inflated balloon following automatic stretching of the inflation aperture and constricted neck, and positioning thereof about the upper open end of the tubular member in sealed relation therewith.

Although not essential to the invention, the uppermost edge of collar 69 may, if desired, be provided with a plurality of small, axially extending, evenly spaced notches 80 equal in number to the number of stretcher elements 75 so as to maintain alignment of the stretcher elements 75 as the stretching mechanism 68 is retracted; provided, however, that the lowermost ends of such notches 80 terminate above the inflation air inlet 56 so as to preclude breakage of the seal between the constricted neck portion 58 of the balloon 50 and the collar 69 when the components are in the position shown in FIG. 17.

Figure 18:
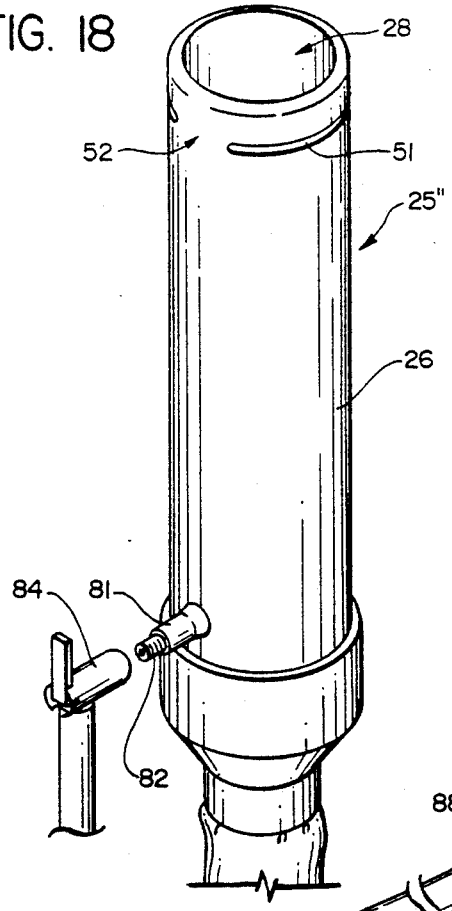
Figure 19:
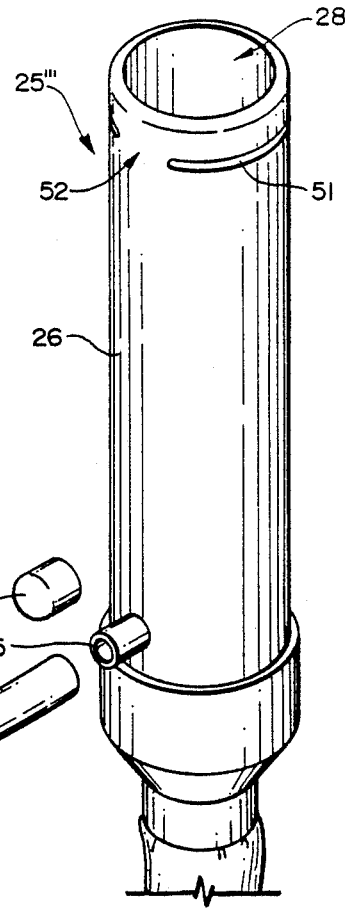
FIG. 19 is a fragmentary isometric view similar to FIG. 18; but here partially exploded and cut away, and illustrating yet another modified form of balloon stuffing system which has been adapted for use with a conventional bellows pump for inflating balloons.
Figure 19:
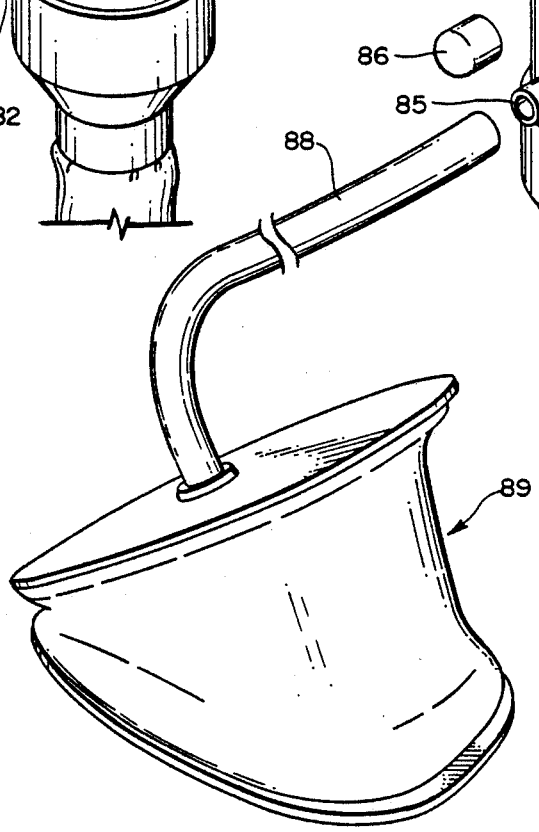

As thus far described, the various embodiments of the present invention have been disclosed employing an electrically powered air inflator 60 (FIG. 5) to inflate the balloons 50. However, those skilled in the art will appreciate that the invention is not limited to the particular type of inflation device employed; but, rather, it can be utilized with a wide range of completely conventional sources of air, helium or other inflation medium. For example, referring to FIG. 18, it will be noted that a modified balloon stuffer, generally indicated at 25", has been illustrated which is substantially identical to the balloon stuffer 25 of FIGS. 1–11 and which could be substantially identical to the modified balloon stuffer 25' of FIGS. 12–17, except that in this instance, the inflation air inlet 56 of the prior embodiments has been replaced with a completely conventional inlet valve 81 having a threaded male extremity 82 for separable coupling with a complementally shaped threaded female coupler 84 associated with any conventional source of air, helium or other inflation medium such, merely by way of example, as a tire pump. Similarly, reference to FIG. 19 will reveal yet another modified balloon stuffer 25''' embodying features of the present invention wherein the inlet valve simply takes the form of a cylindrical rod 85 having a removable cover 86 which permits the rod to be inserted into the delivery line 88 of a conventional bellows pump, generally indicated at 89, such for example, as the bellows pump marketed by Academy Broadway Corp. of Smithtown, N.Y., as Item No. 860.

Figure 20:
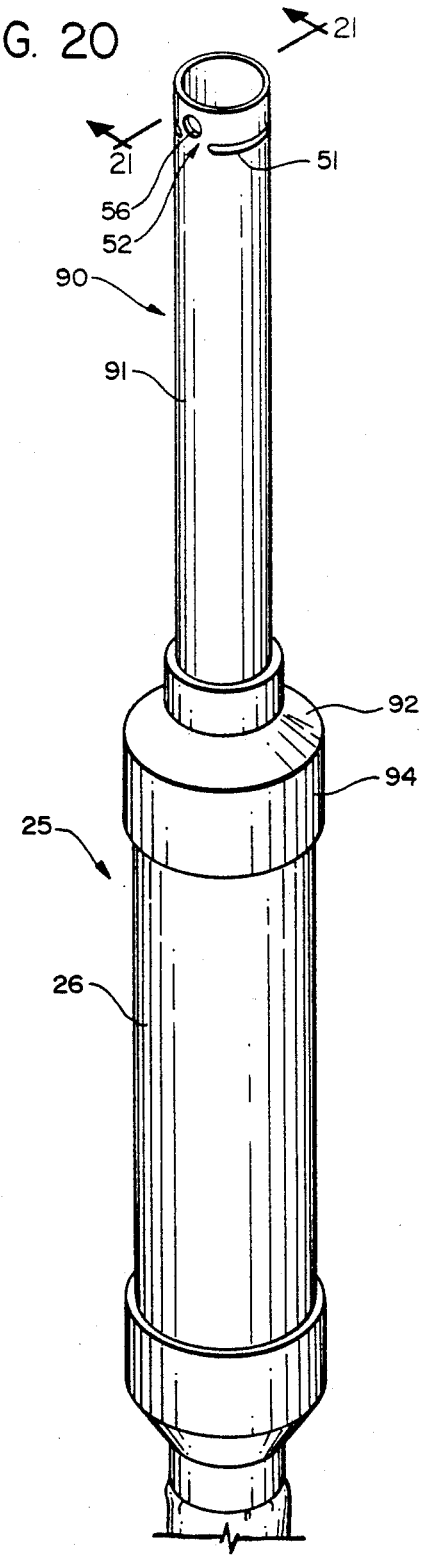
FIG. 20 is a fragmentary isometric view of yet another modified form of balloon stuffing system, here employing an adapter suitable for mounting at the open end of the tubular member of the balloon stuffer shown in FIG. 1 for usage with relatively small balloons; and, FIG. 21 is a vertical sectional view, taken substantially along the line 21—21 of FIG. 20, and here illustrating usage of the modified form of the invention shown in FIG. 20 for inserting a small flower into the interior of a relatively small inflated balloon.
Figure 21:
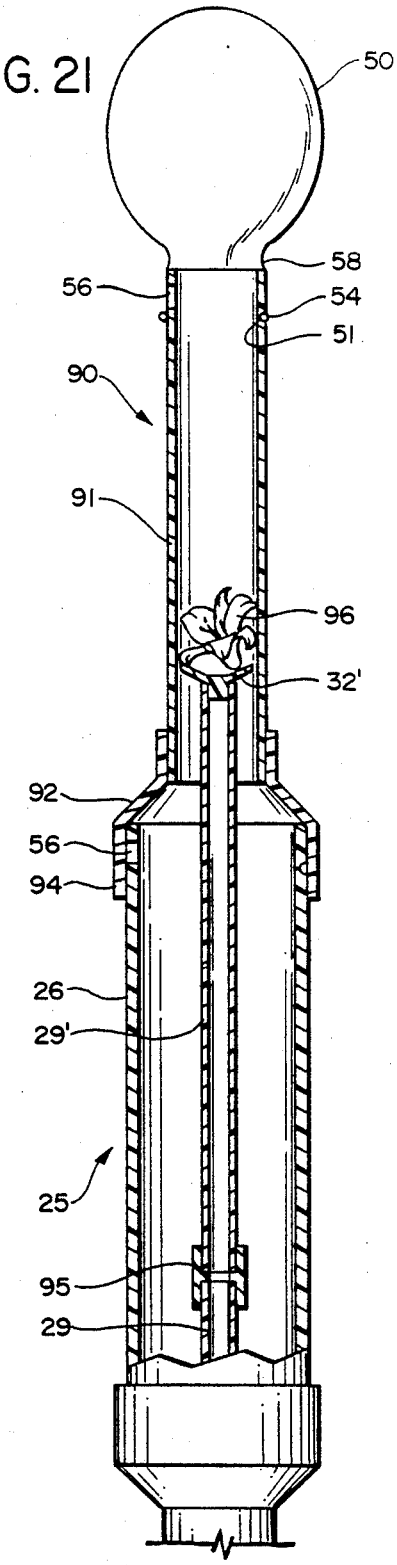

Turning next to FIGS. 20 and 21, there has been illustrated a further modification of the present invention which readily permits usage of balloon stuffers 25, 25', 25" and/or 25''' of the type shown in FIGS. 1–19 and having a relatively large diameter tubular member 26—e.g., three inches (3"), four inches (4"), five inches (5"), or more—to be used for inflating and stuffing relatively small balloons. Thus, as here shown, an adapter assembly, generally indicated at 90, including a tubular member 91 of substantially reduced internal diameter—e.g., on the order of approximately one and three quarter inches (1 ¾")—is provided having an outwardly flared expander coupling 92 dimensioned to be snuggly mounted about the uppermost open end 28 of tubular member 26 in a relatively large balloon stuffer 25 (or, 25', 25", 25''') in airtight sealed relation thereto. Coupling 92 preferably terminates in a large diameter cylindrical flange 94 having an inside diameter essentialy the same as the outside diameter of tubular member 26 and having a length sufficiently great as to close and seal the inflation air inlet 56 in tubular member 26, as best shown in FIG. 21.

In carrying out this aspect of the invention, the adapter assembly 90 also includes an ejector rod extension 29' and coupling element 95 enabling removal of the ejector support platform 32 from ejector rod 29, coupling of the ejector rod extension 29' to the ejector rod 29, and placement of a relatively small diameter ejector support platform 32' at the free end of the ejector rod extension 29'. The uppermost end of the tubular member 91 on the adapter assembly 90 is, although smaller in diameter than the open end 28 of tubular member 26, otherwise identical in construction to one of those previously described—for example, to the open end 28 of the tubular member 26 depicted in FIGS. 1–11 having a groove 51, an ungrooved arcuate portion 52, and an inflation air inlet 56. Thus, the use of the adapter assembly 90 readily permits usage of even a large diameter balloon stuffer 25 (or, 25', 25'', 25''') to inflate relatively small balloons 50 and to insert, for example, small, delicate and fragile favors such as a flower of the type generally indicated at 96 in FIG. 21.

Thus, those skilled in the art will appreciate that there have herein been described various embodiments of a balloon stuffing system which are characterized by their simplicity, compactness, ruggedness and lack of moving parts, yet which readily permit the insertion of various types of favors ranging from small flowers and/or buds upwardly in size to relatively large stuffed animals or the like through the inlet aperture and constricted neck portion of an inflated balloon and into the balloon's interior, whereupon the inflated balloon and its contents may be removed from the balloon stuffing system and tied off or otherwise sealed to retain the favor captive within the inflated balloon.

Those persons skilled in the art will further appreciate that many modifications can be made to the balloon stuffing systems of the present invention without departing from the spirit and scope of the invention as expressed in the appended claims. Merely by way of example, the tubular member 26 of the balloon stuffer 25, 25', 25'', 25''' need not be round, but could be polygonal. The pisto-like ejector rod assemblies 29, 29', 32, 32' could be replaced with a true piston arrangement. Indeed, the entire system could be automated or rendered semiautomatic so as to enable inflation and stuffing of balloons on a production line basis.

I claim:

1. The method of stuffing a conventional balloon having an inlet aperture and constricted neck portion with an object such as a stuffed toy or animal, a gift, a flower, or a similar favor, said method comprising the steps of:

(a) positioning the object to be stuffed in a tubular member having:
  (i) a fluid impervious sidewall;
  (ii) a first open end through which the object to be stuffed can be inserted and ejected;
  (iii) a second closed and sealed end;
  (iv) an ejector mechanism movable axially through the tubular member and extending through and projecting beyond the second closed and sealed end thereof; and,
  (v) means for coupling the interior of the tubular member to a source of suitable inflation medium;

(b) stretching the inflation aperture and constricted neck portion of a conventional uninflated balloon over, around and about the first open end of the tubular member so as to enclose and seal the interior of the tubular member;

(c) coupling the coupling means on the tubular member to a source of inflation medium for pressurizing the interior of the tubular member and simultaneously inflating the balloon;

(d) shifting the ejector mechanism axially relative to the tubular member so as to eject the object to be stuffed into the balloon from the first open end of the tubular member and project the object into the interior of the inflated balloon;

(e) removing the inflated balloon from the tubular member; and, (f) knotting or otherwise tying off the constricted neck portion of the inflated balloon so as to seal the inflated balloon with the object stuffed therein being retained captive therein.

2. The method as set forth in claim 1 wherein the inflation aperture and constricted neck portion of the uninflated balloon are manually stretched in Step (b) so as to position the same in surrounding sealed relation with the first open end of the tubular member.

3. The method as set forth in claim 1 wherein the inflation aperture and constricted neck portion of the uninflated balloon are positioned on the reversely bent ends of a plurality of stretcher elements mounted in circumferentially spaced, axially directed relation about the tubular member with freedom for axial sliding movement with respect thereto and wherein the reversely bent ends of the stretcher elements: (i) are located at the ends of inwardly bent portions of the stretcher elements extending beyond the first open end of the tubular member; and (ii), define a keg-shaped configuration having a diameter considerably smaller than that of the tubular member and approximating that of the inflation aperture and constricted neck portion of the uninflated balloon; sliding the stretcher elements axially along the tubular member in a direction away from the first open end thereof so that the inwardly bent portions of the stretcher elements engage the first open end of the tubular member and are cammed outwardly thereby so as to expand the keg-shaped configuration of the reversely bent stretcher element end portions to increase the diameter thereof to a diameter slightly greater than that of the tubular member and thus stretch the inflation aperture and constricted neck portion of the uninflated balloon to a diameter greater than that of the tubular member permitting the stretched inflation aperture and constricted neck portion of the balloon to be drawn downwardly around and about the first open end of the tubular member in surrounding relation thereto; and, withdrawing the stretcher elements from the stretched inflation aperture and constricted neck portions of the balloon so as to deposit the aperture and constricted neck portion of the balloon in surrounding sealed relation to the first open end of the tubular member.

4. The method as set forth in claim 1 wherein the ejector mechanism includes an ejector rod extending out of the second end of the tubular member and mounted in sealed slidable relation with the second end of the tubular member; and, wherein the ejector mechanism is manually shifted in Step (d) by grasping the projecting portion of the ejector rod and pushing it axially towards the first open end of the tubular member so as to eject the object therefrom and insert the object into the inflated balloon.

5. The method as set forth in claim 1 wherein during Step (e) the inflated balloon containing the object stuffed therein is twisted about the axis of the tubular member so as to form a tightly wound constricted neck portion on the balloon creating a temporary seal; and, grasping the tightly wound constricted neck portion as the inflated stuffed balloon is removed from the tubular member to maintain the temporary seal during knotting and/or tying off of the constricted neck portion to form a permanent seal.

6. The method of inflating and stuffing an inflatable balloon of the type having an inlet aperture and a constricted neck portion comprising the steps of:

(a) inserting the object of the stuffed into a tubular member having a first open end and a second closed sealed end and having an ejector rod passing through the second closed seal end thereof and axially slidable therein;

(b) attaching an uninflated balloon to the first open end of the tubular member with the constricted neck portion thereof surrounding and in sealed engagement with the tubular member;

(c) pressurizing the interior of the tubular member and of the balloon so as to inflate the latter;

(d) shifting the ejector rod axially towards the first open end of the tubular member so as to eject the object contained therein and project such object into the interior of the inflated balloon;

(e) removing the inflated stuffed balloon from the tubular member; and, (f) knotting or otherwise tying off the constricted neck portion of the balloon so as to seal the balloon with the object retained captive therein.

7. The method of inflating and stuffing a conventional balloon of the type having an inflation aperture and a constricted neck portion comprising the steps of:

(a) positioning the object to be stuffed in the interior of a tubular member having:

(i) a first open end;

(ii) a second closed sealed end; and, (iii) a manually operable, axially movable, piston-like ejector rod passing through the second closed sealed end of the tubular member into the interior thereof and projecting outwardly beyond the second closed sealed end of the tubular member;

(b) stretching the inlet aperture and constricted neck portion of an uninflated inflatable balloon over, and seating the constricted neck portion of the balloon on, the first open end of the tubular member so as to form a totally enclosed chamber defined in part by the interior of the tubular member and in part by the interior of the balloon;

(c) coupling the tubular member to a source of pressurized fluid to pressurize the totally enclosed chamber so as to inflate the balloon;

(d) shifting the ejector rod axially relative to the tubular member and towards the first open end thereof so as to eject the object contained therein from the tubular member and project it into the inflated balloon mounted on the first open end thereof; and, (e) removing the inflated, stuffed balloon from the tubular member and knotting or otherwise tying off the constricted neck portion thereof to seal the balloon with the object stuffed therein being retained captive therein.

8. A balloon stuffer comprising, in combination, a tubular member which is open at one end and sealed at the other; a manually operable, axially movable, piston-like ejector rod passing through said sealed end of said tubular member and extending on one end into said tubular member while projecting at its opposite end beyond the sealed end of said tubular member; and, means for connecting the interior of said tubular member to a source of air, helium or other suitable inflation medium.

9. A balloon stuffer for use in stuffing toys, stuffed animals, gifts, flowers and similar favors into the interior of conventional inflated balloons of the type having an inflation aperture and a constricted neck aportion, comprising, in combination:

(a) a tubular member having:

(i) a first open end adapted to receive the favor to be stuffed into a balloon and to temporarily store such favor entirely within said tubular member;

(ii) a second closed sealed end; and, (iii) a fluid impervious sidewall;

(b) piston-like ejector means disposed within said tubular member and projecting outwardly beyond said second closed sealed end of said tubular member with freedom for axial movement through said second closed sealed end;

(c) means for coupling the interior of said tubular member to a source of inflation fluid; and, (d) means for axially shifting said piston-like ejector means so as to engage the favor temporarily stored therein and eject such favor from said tubular member; whereby stretching and seating of the inflation aperture and constricted neck portion of a conventional uninflated inflatable balloon over and about said first open end of said tubular member serves to create a totally enclosed sealed chamber comprising the interior of said tubular member and the interior of the balloon, and coupling of said coupling means to a source of fluid under pressure and energization thereof serves to pressurize the totally enclosed sealed chamber and to inflate the balloon, so that actuation of said means for axially shifting said piston-like ejector means causes ejection of the favor contained within said tubular member and insertion of the favor into the interior of the inflated balloon, whereupon the inflated balloon and the favor stored therein may be removed from said tubular member and the constricted neck portion of the inflatable balloon knotted or otherwise tied off so as to seal the balloon in the inflated state with the favor stored therein.

10. A balloon stuffer as set forth in claim 9 wherein said piston-like ejector means includes:

(a) an ejector rod passing through and projecting beyond said second closed sealed end of said tubular member; and, (b) an elongate, flexible, bellows-like sealing element surrounding said ejector rod and secured in sealed relation at one end thereof to said second closed sealed end of said tubular member and at the opposite end thereof to said projecting end of said ejector rod; whereby the user of said balloon stuffer activates said means for axially shifting said piston-like ejector means by manually grasping said projecting portion of said ejector rod and pushing said rod axially through said tubular member toward said first open end thereof.

11. A balloon stuffer as set forth in claim 10 wherein said elongate flexible, bellow-like sealing element comprises a thin, flexible, fluid-impervious, tubular membrane.

12. A balloon stuffer as set forth in claim 11 wherein said projecting portion of said ejector rod and said membrane are encased within a flexible protective cover.

13. A balloon stuffer as set forth in claim 9 wherein said means for coupling the interior of said tubular member to a source of inflation fluid comprises an inflation air inlet adapted to receive an air inlet nozzle of a conventional inflation device.

14. A balloon stuffer as set forth in claim 13 wherein said inflation air inlet is located in said sidewall of said tubular member adjacent said first open end of said tubular member so as to permit closure and sealing of said inlet by the constricted neck portion of the balloon when mounted on said first open end of said tubular member whereby when the inlet nozzle of the inflation device is to be inserted into said inlet, it is merely necessary to roll the constricted neck portion of the balloon upwardly a distance sufficient to expose said inlet and upon removal of the nozzle from said inlet the constricted neck portion of the balloon can be rolled down to reseal said inlet.

15. A balloon stuffer as set forth in claim 9 wherein said means for coupling the interior of said tubular member to a source of inflation fluid comprises an air inlet valve suitable for coupling to a tire pump and the like.

16. A balloon stuffer as set forth in claim 9 wherein said means for coupling the interior of said tubular member to a source of inflation fluid comprises a latterally projecting tubular element and a removable cover therefor for permitting removal of the cover and coupling of the tubular element with the inlet line of a conventional bellows pump.

17. A balloon stuffer as set forth in claim 9 having means partially surrounding said first open end of said tubular member and defining a seat for receiving the rolled bead at the inflation aperture of a conventional balloon.

18. A balloon stuffer as set forth in claim 17 wherein said seat defining means comprises a groove formed in and extending circumferentially partially around the outer surface of said tubular member.

19. A balloon stuffer as set forth in claim 17 wherein said seat defining means comprises a collar formed adjcent said first open end of said tubular member and defining an inturned radial flange partially surrounding said tubular member.

20. A balloon stuffer as set forth in claim 18 wherein said means for coupling the interior of said tubular member to a source of inflation fluid comprises an inflation air inlet adapted to receive an air inlet nozzle of a conventional inflation device, said inflation air inlet being centered between the opposite ends of said groove and located approximately midway between the plane containing said groove and the plane containing said first open end of said tubular element so that the constricted neck portion of the balloon normally seals said inlet so that the user may readily push the constricted neck portion of the balloon upwardly both to expose the inlet and to facilitate removal of the balloon from said tubular member upon inflation and stuffing thereof.

21. A balloon stuffer as set forth in claim 19 wherein said means for coupling the interior of said tubular member to a source of inflation fluid comprises an inflation air inlet adapted to receive an air inlet nozzle of a conventional inflation device; said collar includes a ramp located between the opposite ends of said radial flange; and, said inlet is formed in said collar between the opposite ends of said radial flange and is located approximately midway between the plane containing said radial flange and the plane containing said first end of said tubular member so as to facilitate shifting of the rolled bead on the inflation aperture of the balloon to expose said inlet and to facilitate removal of the balloon from said tubular member.

22. A balloon stuffer as set forth in claim 9 wherein said piston-like ejector means includes an ejector rod extending through and beyond said second closed sealed end of said tubular member and being mounted in sealed relation to said tubular member with freedom for axial movement with respect thereto.

23. A balloon stuffer as set forth in claim 22 wherein said piston-like ejector means includes an ejector support platform mounted on the end of said ejector rod disposed within said tubular member.

24. A balloon stuffer as set forth in claim 23 wherein said platform is disc-shaped; and, a wiping-type sealing element is mounted in the periphery of said platform and in engagement with said sidewall of said tubular member for establishing a sliding seal between said ejector means and said tubular member.

25. A balloon stuffer as set forth in claim 24 wherein said platform terminates at its outermost end in an axially extending frusto-conical portion having an outwardly flared lip at its apicad end of substantially smaller diameter than the diameter of said tubular member for permitting the constricted neck portion of thick wall balloons to be slipped off of said tubular member and on to said frusto-conical portion after inflation and stuffing of the balloon so as to facilitate removal of the inflated stuffed balloon from said balloon stuffer.

26. A balloon stuffer as set forth in claim 9 comprising a second tubular member removably mounted on said first open end of said first mentioned tubular member in sealed relation thereto, said second tubular member being substantially identical to said first mentioned tubular member except for having a diameter at its first open end which is substantially smaller than the diameter of said first mentioned tubular member for permitting inflation and stuffing of relatively small balloons having constricted neck portions incapable of being stretched about the relatively large diameter first open end of said first mentioned tubular member.

27. A balloon stuffer as set forth in claim 26 further including an extension ejector rod mounted on said piston-like ejector means and extending into said second tubular member.

28. A balloon stuffer as set forth in claim 9 further having latterally projecting mounting means secured to said tubular member for permitting said balloon stuffer to be mounted on a table or similar work surface with said tubular member in a generally upright vertical position.

29. The method of stretching the inflation aperture and constricted neck portion of a conventional uninflated balloon and positioning the stretched inflation aperture and constricted neck portion of the uninflated balloon on the end of a tubular member in surrounding sealed relation with respect thereto, said method comprising the steps of:

(a) positioning a plurality of stretcher elements about the periphery of the tubular member with each stretcher element having:
  (i) a first axially directed end portion adjacent the outer surface of the tubular member;
  (ii) a second axially directed intermediate portion extending beyond the end of the tubular member and angled inwardly towards, but terminating short of, the axis of the tubular member; and,
  (iii) a third axially directed end portion; and, wherein the first axially directed end portions of the plurality of stretcher elements are disposed in a generally cylindrical array surrounding the tubular member, the second axially directed intermediate portions of the plurality of stretcher elements are disposed in a generally frusto-conical array extending beyond the end of the tubular member, and the third axially directed ends portions of the plurality of stretcher elements are disposed in a generally cylindrical array at the apicad end of the frusto-conical array and lie in a generally cylindrical plane having a diameter which closely approximates the diameter of the inflation aperture and constricted neck portion of the uninflated balloon to be stretched;

(b) placing the inflation aperture and constricted neck portion of the uninflated balloon about the third axially directed end portions of the stretcher elements;

(c) moving the plurality of stretcher elements, in unison, axially along the tubular member in a direction away from the end thereof so as to retract the second axially directed intermediate portions of the stretcher elements over the end of the tubular member and thus cam such second axially directed intermediate portions outwardly, thereby expanding the third axially directed end portions of the plurality of stretcher elements outwardly away from the axis of the tubular member and stretching the diameter of the inflation aperture and constricted neck portion of the uninflated balloon placed thereon to a diameter slightly greater than the diameter of the tubular member while drawing the thus stretched inflation aperture and constricted neck portion of the uninflated balloon axially over and around the end of the tubular member in surrounding relation thereto; and, (d) withdrawing the plurality of stretcher elements from the expanded inflation aperture and constricted neck portion of the uninflated balloon so as to seat the inflation aperture and constricted neck portion of the balloon in surrounding sealed relation on the end of the tubular member.

30. The method of stretching the inflation aperture and constricted neck portion of a conventional uninflated balloon and positioning the stretched inflation aperture and constricted neck portion of the uninflated balloon on the end of a tubular member in surrounding sealed relation with respect thereto, said method comprising the steps of:

(a) positioning a balloon stretching mechanism having:

(i) means defining a collar; and, (ii) a plurality of elongated stretcher elements hingedly mounted to the collar defining means and extending generally axially with respect to the collar defining means with each stretcher element being applied inwardly about midway along its axial length and terminating in an axially extending and slightly reversely bent end portion so that the end portions of all of the plurality of stretcher elements define a relatively small diameter keg-shaped configuration readily insertable into the inflation aperture and constricted neck portion of an uninflated balloon; about a tubular member with freedom for sliding movement axially therealong and with the inwardly angled portions of the stretcher elements being located beyond the end of the tubular member so that the diameter of the keg-shaped configuration of stretcher element end portions is considerably smaller than the diameter of the tubular member and approximates the diameter of the inflation aperture and constricted neck portion of an uninflated balloon;

(b) placing the inflation aperture and constricted neck portion of an uninflated balloon about the keg-shaped end portions of the stretcher elements;

(c) sliding the collar defining means axially along the tubular member away from the end thereof so as to retract the inwardly angled portions of the stretcher elements over the end of the tubular member and thus cam them outwardly, in unison, so as to increase the diameter of the keg-shaped configuration of stretcher element end portions and thus expand the inflation aperture and constricted neck portion of the uninflated balloon mounted thereon until the diameter thereof is slightly greater than the diameter of the tubular member and the thus expanded inflation aperture and constricted neck portion of the balloon are drawn downwardly over and around the end of the tubular member; and, (d) withdrawing the plurality of stretcher elements from the expanded inflation aperture and constricted neck portion of the balloon so as to seat the inflation aperture and constricted neck portion of the balloon in surrounding sealed relation to the end of the tubular member.

31. The method as set forth in claim 30 wherein the collar defining means comprise first and second mating complemental C-shaped collar sections hingedly connected together, and wherein the balloon stretching mechanism is positioned about the tubular member in Step (c) by spreading the hinged collar sections, positioning the spread hinged collar sections about the tubular member, and closing the hinged collar sections so as to snuggly conform to the outer surface of the tubular member with freedom for axial sliding movement therealong.

32. A balloon stretching mechanism for automatically stretching the inflation aperture and constricted neck portion of a conventional uninflated balloon so as to permit attachment of the uninflated balloon in surrounding relation to an end of a tubular member, said balloon stretching mechanism comprising, in combination;

(a) means defining a support adapted to be deployed about, and in at least partially surrounding relation to, the tubular member with freedom for axial movement with respect thereto;

(b) a plurality of stretcher elements mounted on said support defining means and adapted to be disposed about the periphery of the tubular member with each stretcher element having:

(i) a first axially directed end portion adjacent the outer surface of the tubular member;

(ii) a second axially directed intermediate portion extending beyond the end of the tubular member and angled inwardly towards, but terminating short of, the axis of the tubular member; and, (iii) a third axially directed end portion; and, wherein said first axially directed end portions of said plurality of stretcher elements are adapted to be disposed in a generally cylindrical array surrounding the tubular member, said second axially directed intermediate portions of said plurality of stretcher elements are adapted to be disposed in a generally frusto-conical array extending beyond the end of the tubular member, and said third axially directed end portions of said plurality of stretcher elements are adapted to be disposed in a generally cylindrical array at the apicad end of said frusto-conical array and to lie in a generally cylindrical plane having a diameter which closely approximates the diameter of the inflation aperture and constricted neck portion of the uninflated balloon to be stretched; and, (C) means for moving said support defining means and said plurality of stretcher elements mounted thereon, in unison, in an axial direction along the tubular member in a direction away from the end thereof; whereby when the inflation aperture and constricted neck portion of an uninflated balloon are placed about said third axially directed end portions of said plurality of stretcher elements and said plurality of stretcher elements are moved axially along the tubular member in a direction away from the end thereof, said second axially directed intermediate portions of said plurality of stretcher elements engage the end of the tubular member and are cammed outwardly thereby, thus expanding said third axially directed end portions of said plurality of stretcher elements outwardly away from the axis of the tubular member so as to stretch the diameter of the inflation aperture and constricted neck portion of the uninflated balloon placed thereon to a diameter slightly greater than the diameter of the tubular member and so that upon further axial movement of said plurality of stretcher elements in a direction away from the end of the tubular member, the stretched inflation aperture and constricted neck portion of the uninflated balloon are drawn axially over and around the end of the tubular member and are deposited thereon in sealed surrounding relation thereto.

33. A balloon stretching mechanism for automatically stretching the inflation aperture and constricted neck portion of a conventional uninflated balloon so as to permit attachment of the balloon in surrounding relation to an end of a tubular member, and balloon stretching mechanism comprising, in combination:

(a) means defining a collar adapted to be mounted about the tubular member with freedom for axial movement with respect thereto; and, (b) a plurality of stretcher elements hingedly mounted on said collar defining means and adapted to extend axially along the tubular member towards the end thereof, each of said plurality of stretcher elements including an inwardly bent portion converging towards the axis of the tubular member beyond the end thereof and terminating in a reversely bent portion such that the reversely bent portions of the plurality of stretcher elements are closely spaced and define a keg-shaped configuration having an external diameter approximately equal to the diameter of the unstretched inflation aperture and constricted neck portion of a conventional uninflated balloon;

whereby, when the inflation aperture and constricted neck portion of a conventional uninflated balloon are placed about said reversely bent end portions of said plurality of stretcher elements and said collar defining means are shifted axially away from the end of the tubular member, said stretcher elements are cammed outwardly upon engagement of said inwardly bent portions with the end of the tubular member so as to increase the diameter of said keg-shaped configuration defined by said reversely bent end portions on said stretcher elements and thus stretching the inflation aperture and constricted neck portion of the conventional uninflated balloon to increase the diameter thereof to a diameter slightly greater than the outside diameter of the tubular member and so that as the collar defining means are further retracted away from the end of the tubular member, the stretched inflation aperture and constricted neck portion of the uninflated balloon are drawn downwardly about and around the end of the tubular member and deposited thereon in sealed relation with respect thereto.

34. A balloon stretching mechanism as set forth in claim 33 wherein said collar defining means comprises a pair of mating, complemental, C-shaped collar sections, and means for securing said sections together.

35. A balloon stretching mechanism as set forth in claim 33 wherein said sections are hingedly connected together.

* * * * *